US005402114A

United States Patent [19]

Sun

[11] Patent Number: 5,402,114

[45] Date of Patent: Mar. 28, 1995

[54] CITY BUS LINE ENQUIRY MACHINE

[76] Inventor: Hann Sun, 5F, No.12, Alley 5, Lane 192, Sec.5, Roosevelt Road, Taipei, Taiwan, Prov. of China

[21] Appl. No.: 208,306

[22] Filed: Mar. 10, 1994

[51] Int. Cl.[6] ..... G08B 5/00

[52] U.S. Cl. ..... 340/815.45; 340/815.48; 345/82; 40/606

[58] Field of Search ..... 345/2, 168, 207, 447, 345/82; 40/606, 607; 235/431; 312/222, 210; 340/815.45, 815.48

[56] References Cited

U.S. PATENT DOCUMENTS 4,561,704 12/1985 Smith ..... 312/222
5,162,785 11/1992 Fagard ..... 345/207
5,283,595 2/1994 Krukovsky ..... 345/2

FOREIGN PATENT DOCUMENTS 2194662 3/1988 United Kingdom .
2018969 10/1992 WIPO .

*Primary Examiner*—Alvin E. Oberley
*Assistant Examiner*—Gin Goon
*Attorney, Agent, or Firm*—Browdy and Neimark

[57] ABSTRACT

A city bus line enquiry machine includes a diode selector circuit, which includes a plurality of key switches marked with respective names of bus stops and a plurality of light emitting diodes marked with respective bus line codes and connected to the key switches respectively, and a power supply and sound generating circuit, which provides the necessary working voltage to the automatic lighting device and gives sound when either key switch of the diode selector circuit is depressed, wherein when either key switch bearing the name of a respective bus stop is depressed, the related light emitting diodes are turned on to show available bus lines passing through the bus stop in question.

2 Claims, 5 Drawing Sheets

| KEY SWITCH | DIODE | LED |
|---|---|---|
| B1 | 3,6 | 3,5 |
| B2 | 10,11,12,13,14 | 1,2,4,6,7 |
| B3 | 15,16,17 | 3,5,6 |
| B4 | 18,19,20,21 | 2,4,5,6 |
| B5 | 22,23,24,25,26 | 1,3,4,6,7 |

CITY BUS LINE ENQUIRY MACHINE

BACKGROUND OF THE INVENTION

The present invention relates to a city bus line enquiry machine adapted to be installed in either bus stop of either city bus line of a city for searching the names of the bus stops of a specific city bus line.

A city bus company generally has an enquiry department or center to answer consumers' enquiry about the names of the bus stops of any available city bus line. However, one must know the telephone number of the enquiry department or center of the city bus company to be enquired before making an enquiry over the telephone, or go directly to the enquiry department or center of the city bus company to ask for the answer. Guidebooks for city bus lines may be prepared by city bus companies and distributed through booths, stalls, and retail stores nearby bus stops. However, it is still not convenient to search the names of the bus stops of a specific city bus line from a guidebook.

SUMMARY OF THE INVENTION

The present invention has been accomplished to provide a city bus line enquiry machine which eliminates the aforesaid problems.

According to the present invention, the city bus line enquiry machine has key switches marked with respective names of bus stops, and light emitting diodes marked with respective bus line codes. When either key switch bearing the name of a respective bus stop is depressed, the related light emitting diodes are turned on to show available bus lines passing through the bus stop in question.

DETAILED DESCRIPTION OF THE PREFERRED EMBODIMENT

Figure 1:
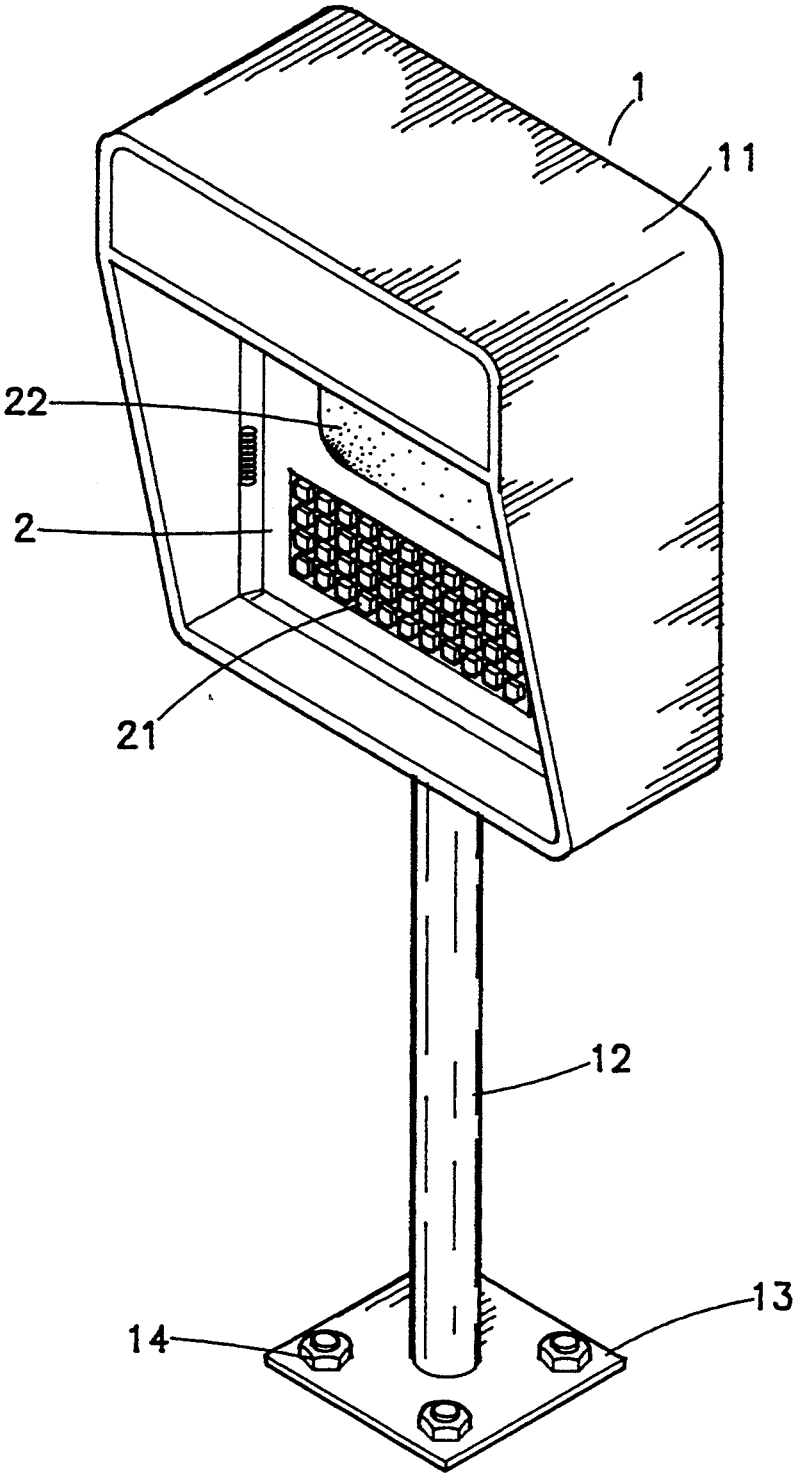
FIG. 1 is an elevational view of a city bus line enquiry machine according to the preferred embodiment of the present invention.
Figure 2:
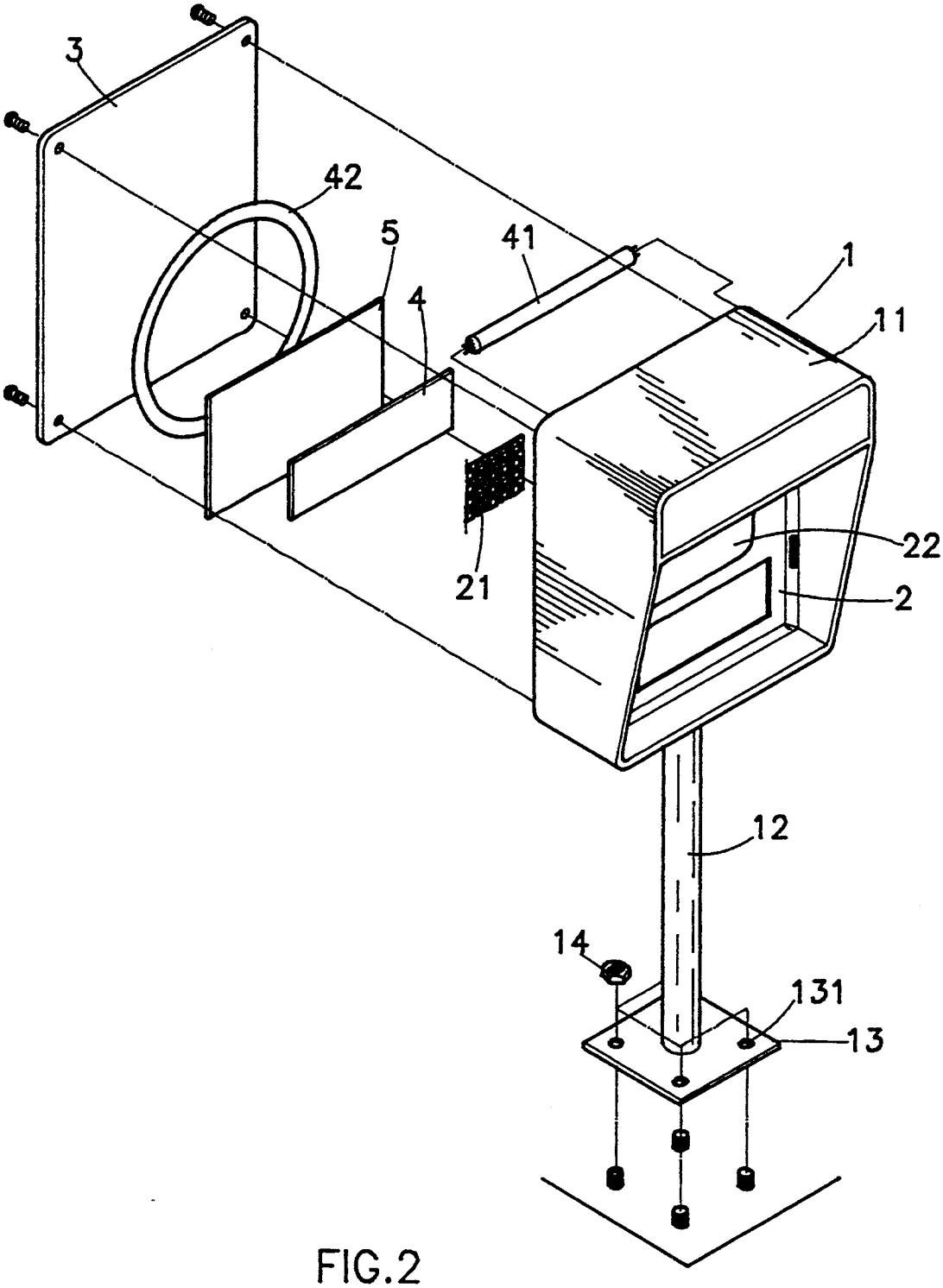
FIG. 2 is an exploded view of the city bus line enquiry machine shown in FIG. 1.

Referring to FIGS. 1 and 2, the city bus line enquiry machine is comprised of a cabinet 1, a front panel 2, a back panel 3, an automatic lighting device 4, and a circuit board 5.

The cabinet 1 comprises a cabinet body 11, preferably of injection-molded plastics, a round post 12 extended downward from the cabinet body 11, and a square mounting plate 13 at the bottom of the round post 12. The square mounting plate 13 has screw holes 131 for mounting on the ground, Screw rods 141 are fastened to the ground for mounting the square mounting plate 13 by screw nuts 14.

The front panel 2 and the back panel 3 are preferably molded from acrylic resin. The front panel 2 is fastened to the cabinet body 11 of the cabinet 1 at the front by screws, having key switches 21 marked with respective names of bus stops, and a bus line code display area 22.

The back panel 3 is fastened to the cabinet body 11 of the cabinet 1 at the back by screws, and served as a signboard.

The automatic lighting device 4 is comprised of two fluorescent lamps 41;42 controlled to give light by a CdS (photosensitive resistor). When the surrounding intensity of light drops below a predetermined level, the CdS is conducted to turn on the fluorescent lamps 41;42 causing them to give light. On the contrary, when the surrounding intensity of light is increased over the predetermined level, the CdS is electrically disconnected, and therefore the fluorescent lamps 41;42 are turned off.

Figure 3:
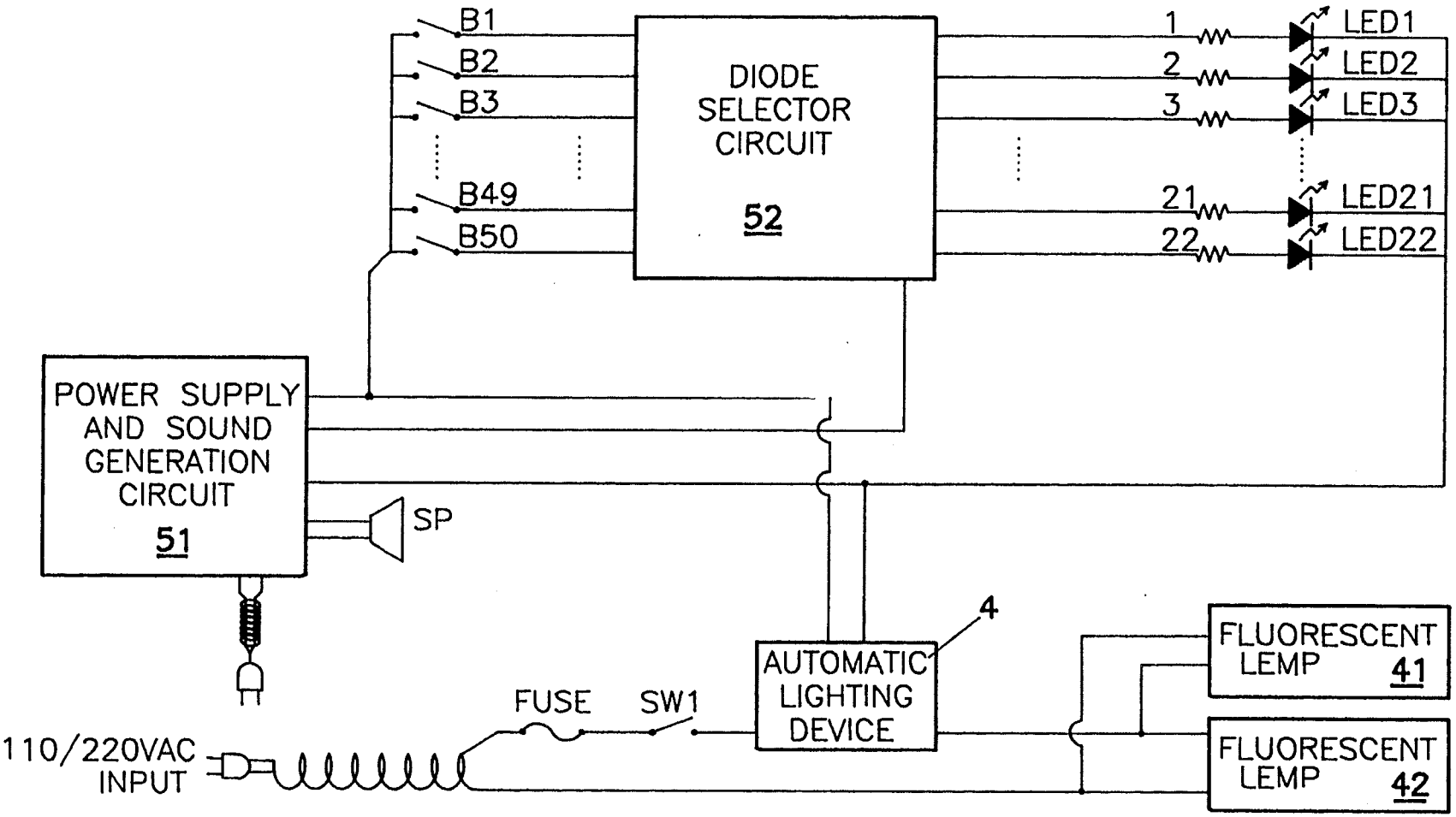
FIG. 3 is a circuit block diagram according to the present invention.
Figure 4:
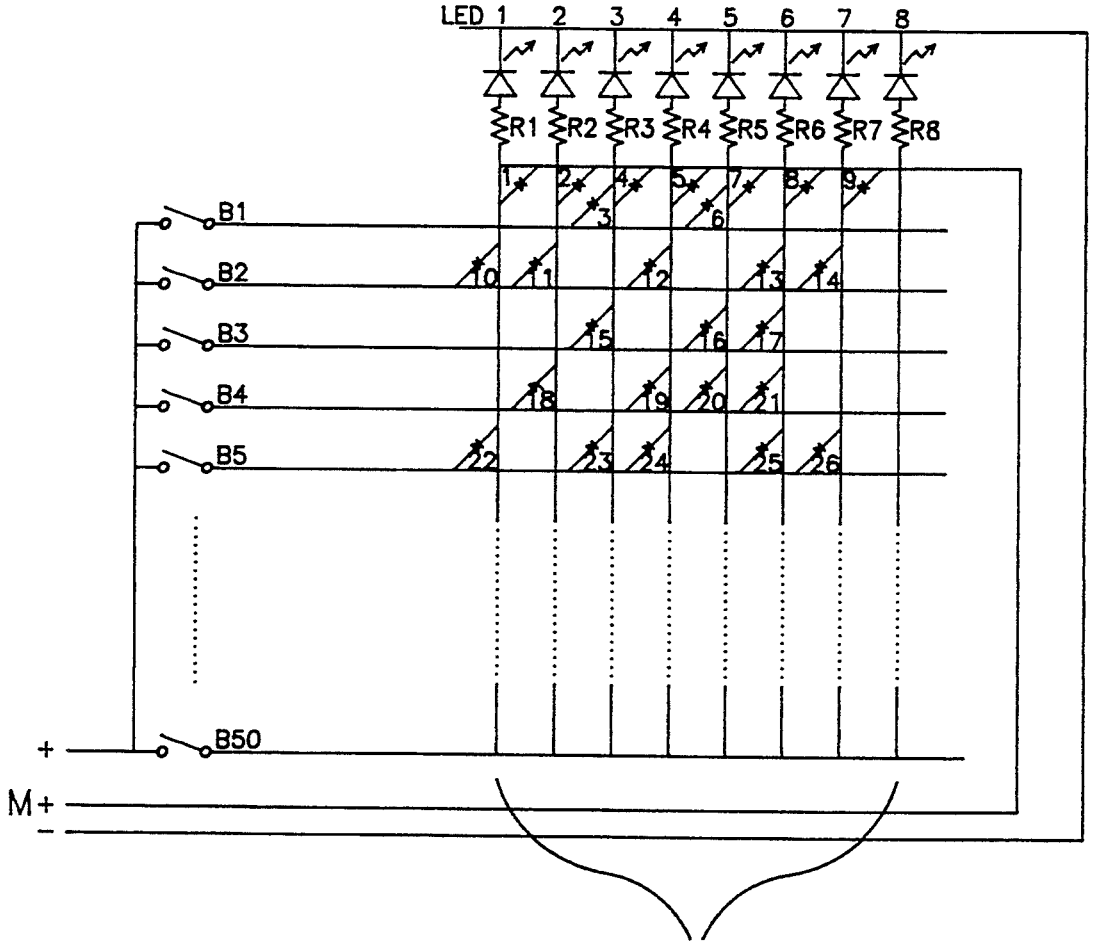
FIG. 4 shows the arrangement of the diode selector circuit according to the present invention.
Figure 5:
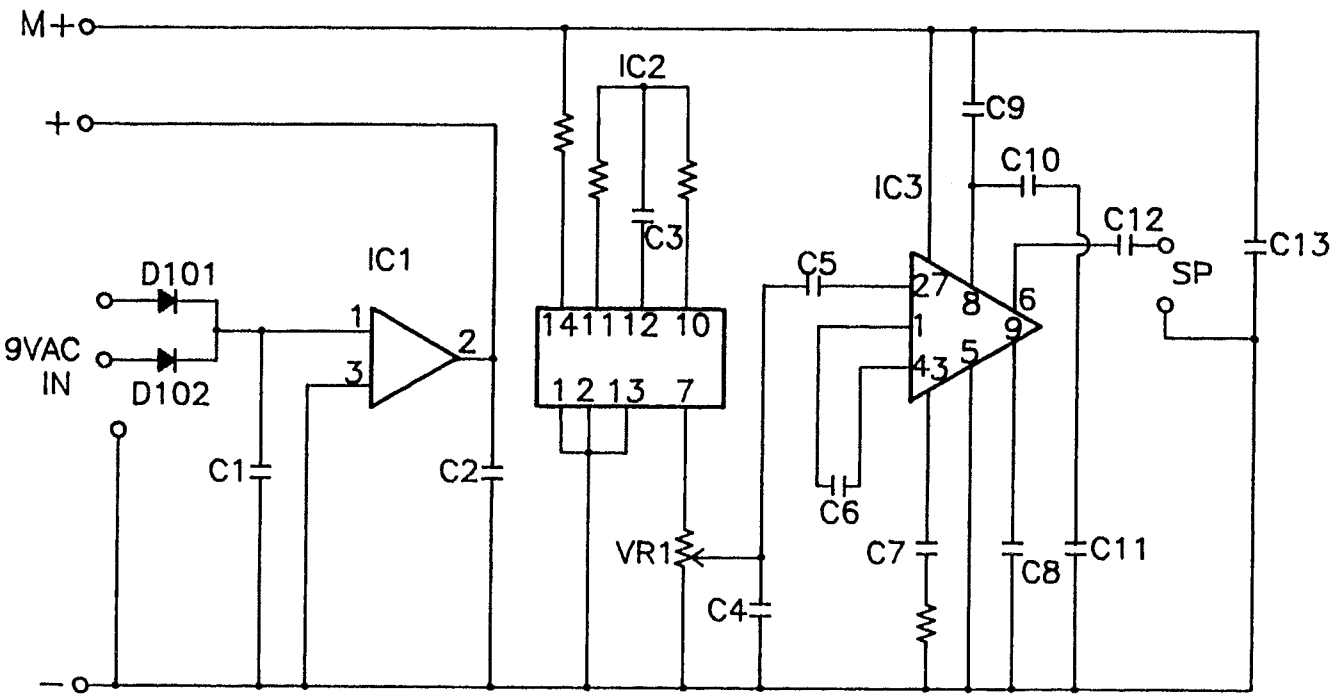
FIG. 5 is a circuit diagram of the power supply and sound generating circuit according to the present invention.

Referring to FIGS. 3, 4, and 5, the circuit board 5 consists of a power supply .and sound generating circuit 51, and a diode selector circuit 52. When power switch SW1 is switched on, the automatic lighting device is actuated to control the operation of the fluorescent lamps automatically. 110/220 VAC is transformed by the power supply and sound generating circuit, then rectified by D101 and D102 and filtrated by capacitor C1, and then treated through IC1, and therefore a working voltage is provided by IC1 to the diode selector circuit. IC2 is an audio frequency oscillatory circuit which produces a specific audio frequency output through the seventh pin. Variable resistor VR1 is to regulate the volume of sound. IC3 is to amplify the audio frequency for permitting it to be sent out by the sixth pin through speaker SP via capacitor C12. Power supply to IC2 and IC3 is provided by the M+ connector of the diode selector circuit. The diode selector circuit obtains power supply from IC1. As shown in FIG. 4, key switches B1 through B50 are marked with names of bus stops respectively; LED1*a* and etc. are indicator lamps showing respective bus line codes; R1 and etc. are current limit resistors; D1 and etc. form the diode selector circuit. When either key switch, for example, the first key switch B1 is depressed, electric current passes through the first key switch B1 and diodes D3 and D6 causing LED3 and LED 5 turned on, at the same time electric current also passes through D4 and D7 to provide a positive voltage to M+ causing the sound generating circuit to produce a sound. When the key switch is released, the circuit returns to the standby mode. If the second key switch B2 is depressed to check how many bus lines are available at such a bus stop, diodes D10;D11;D12;D13;D14 are conducted, and LED1;LED2;LED4; LED6;LED7 are turned on to show that there are five bus lines available at the bus stop in question. When the respective LEDs are turned on, a sound is simultaneously produced. The arrangement of the names of the bus stops (key switches) and the bus line codes (LEDs) can be changed according to different bus line networks. The present preferred embodiment shows 50 bus stops and 22 bus line codes. However, the capacity of the enquiry machine can be extended as desired.

What is claimed is:

1. A city bus line enquiry machine comprising:

a cabinet having a round post at the bottom terminating in a square mounting plate for fastening to the ground by screw rods and screw nuts;

an acrylic front panel fastened to said cabinet at the front by screws, having key switches marked with respective names of bus stops, and a bus line code display area;

an acrylic sign board fastened to said cabinet at the back by screws;

an automatic lighting device disposed inside said cabinet, said automatic lighting device comprising a plurality of fluorescent lamps controlled by a CdS (photosensitive resistor) to give light subject to the surrounding intensity of light; and a circuit board installed inside said cabinet and connected to said automatic lighting device, said circuit board comprising a diode selector circuit, which comprises a plurality of key switches marked with respective names of bus stops and a plurality of light emitting diodes marked with respective bus line codes and connected to said key switches respectively, and a power supply and sound generating circuit, which provides a working voltage to said automatic lighting device and gives sound when either key switch of said diode selector circuit is depressed.

2. A city bus line enquiry machine comprising a post mounted and ground attached cabinet;

an automatic lighting device disposed in said cabinet;

said automatic lighting device including a plurality of lamps, a photosensitive device controlling said lamps to operate to give light subject to the surrounding intensity of ambient light;

a circuit board installed inside said cabinet and connected to said automatic lighting device;

said circuit board including a plurality of key switches each marked with a respective name of a bus stop, a plurality of light emitting diodes each marked with a respective bus line code and connected to respective ones of said key switches, a power supply and a sound generating circuit, said sound generating circuit connected to said plurality of key switches to emit a sound when any of said key switches is depressed, said power supply connected to supply a working voltage to said automatic lighting device, said key switches each having two terminals, one of each of which is connected in a parallel arrangement to a first terminal of said power supply and the other terminal of each of said key switches which is connected to an extended line parallel to extended lines from the other terminals of said key switches, said light emitting diodes each having two terminals with one terminal of each connected in a parallel arrangement to a second terminal of said power supply and the other terminal of each of said light emitting diodes which is connected to an extended line parallel to extended lines from the other terminals of said light emitting diodes, said extended parallel lines from said key switches and said extended parallel lines from said light emitting diodes forming a matrix configuration of parallel lines, a diode selector circuit formed by said matrix configuration of parallel lines and diodes connected between selected ones of said parallel lines connected to said key switches and said parallel lines connected to said light emitting diodes, said diodes of said diode selector circuit selected to complete circuits between selected ones of said key switches and selected ones of said light emitting diodes to designate bus codes by said light emitting diodes showing buses that stop at bus stops designated by the selected one of said key switches operated to close the circuit between said terminals of said power supply.

* * * * *